US008690403B2

(12) United States Patent
Saxena

(10) Patent No.: US 8,690,403 B2
(45) Date of Patent: Apr. 8, 2014

(54) MULTIFUNCTION TAILLIGHT

(75) Inventor: Sandeep Saxena, Novi, MI (US)

(73) Assignee: Hella KGAA Hueck & Co., Lippstadt (DE)

( * ) Notice: Subject to any disclaimer, the term of this patent is extended or adjusted under 35 U.S.C. 154(b) by 0 days.

(21) Appl. No.: 13/155,240

(22) Filed: Jun. 7, 2011

(65) Prior Publication Data

US 2012/0314437 A1 Dec. 13, 2012

(51) Int. Cl.
*F21V 17/02* (2006.01)

(52) U.S. Cl.
USPC ..... 362/512; 362/498

(58) Field of Classification Search
USPC ..... 362/498, 510, 512
See application file for complete search history.

(56) References Cited

U.S. PATENT DOCUMENTS

2001/0050344 A1* 12/2001 Albou ..... 250/504 R
2008/0013335 A1* 1/2008 Tsutsumi ..... 362/545
2009/0086500 A1* 4/2009 Tatara et al. ..... 362/512

* cited by examiner

*Primary Examiner* — Andrew Coughlin
(74) *Attorney, Agent, or Firm* — Husch Blackwell LLP; Robert C. Haldiman; H. Frederick Rusche

(57) ABSTRACT

A multifunction vehicle light has a housing, at least one light emitter mounted within the housing, and a lens mounted in cooperation with the light and the housing. A filter has a first position and a second position, with the first position being in a light path and the second position being out of the light path. The lens has a first portion and a second portion, with the first portion having a first color and the second portion having a second color. In one embodiment, the filter also has the first color; for example red. The light from the lamp appears to be entirely in the first color when the filter is in its first position and the light from the lamp appears in both the first and second colors when the filter is in its second position, with the colors corresponding to the first and second portions of the lens.

10 Claims, 4 Drawing Sheets

MULTIFUNCTION TAILLIGHT

BACKGROUND OF THE INVENTION

1. Field of the Invention

The field of the invention is in vehicle lighting.

2. Related Art

Vehicle signal lighting needs have traditionally been met by using a plurality of lamps to execute a plurality of functions, including for example, running taillights, brake lights, rear reflectors, side reflectors, rear turn indicators, side turn indicators and reverse lamps. Using this plurality of lights necessarily entails repeated costs for each light source and optical component that executes one of the traditional functions of signal lighting. Moreover, the need for multiple lamp assemblies, housings and lenses creates corresponding constraints of costs and space on vehicle body design.

SUMMARY OF THE INVENTION

A multifunction vehicle light has a housing, at least one light emitter mounted within said housing, and a lens disposed in cooperation with the light and the housing. A filter has a first position and a second position, with the first position being in a light path and the second position being out of the light path. The lens has a first portion and a second portion, with the first portion having a first color and the second portion having a second color. In one embodiment, the filter also has the first color; for example red.

The light from the lamp appears to be entirely in the first color when the filter is in its first position and the light from the lamp appears in both the first and second colors when the filter is in its second position, with the colors corresponding to the first and second portions of the lens.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

DETAILED DESCRIPTION OF THE PREFERRED EMBODIMENTS

Figure 1:
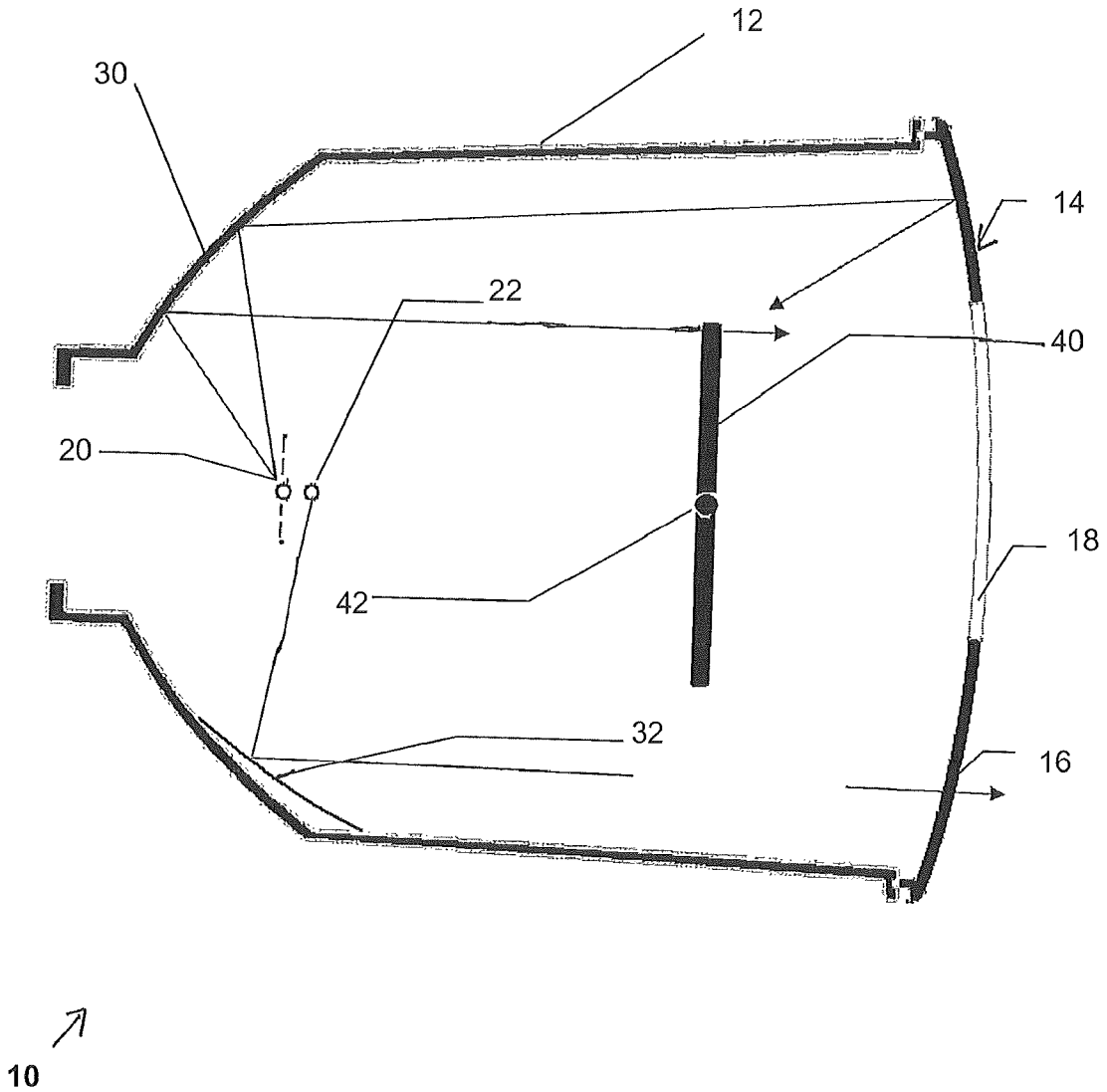
FIG. 1 is a side view of the multifunction taillight with the filter in a first position.

Referring now to the drawings in which like reference numbers refer to like elements, multifunction vehicle lamp 10 is comprised of a housing 12, a lens 14 and a light emitter 20. In the depicted embodiment, there is a primary light emitter 20 and a secondary light emitter 22. The light emitters may be of any source, material or configuration, including without limitation incandescent bulbs, halogen bulbs, xenon bulbs, LEDs or any combination thereof.

The lens 14 is further comprised of a first portion 16 and a second portion 18. The first portion 16 may have a first characteristic such as a color, for example red. The second portion 18 may have a second characteristic, such as color, for example clear, white or yellow. One or both portions of the lens 14 may be configured for a third and separate characteristic, for example reflectivity. Separate characteristic such as reflectivity may be achieved by coatings or configurations of either an external or internal surface such as a lenticular or scalloped surface. Other characteristics may include, without limitation, optical features so as to refract, focus or otherwise shape light beams passing through the lens, in a user selectable fashion.

Housing 12 may include one or more reflective surfaces 30. These may be further shaped to reflect and focus light in a user selectable fashion. Additional dedicated reflective optical elements 32 may also be included. In the depicted embodiment, dedicated optics 32 are disposed to direct light with an enhanced intensity through the first portion 16 of the lens 14.

Figure 2:
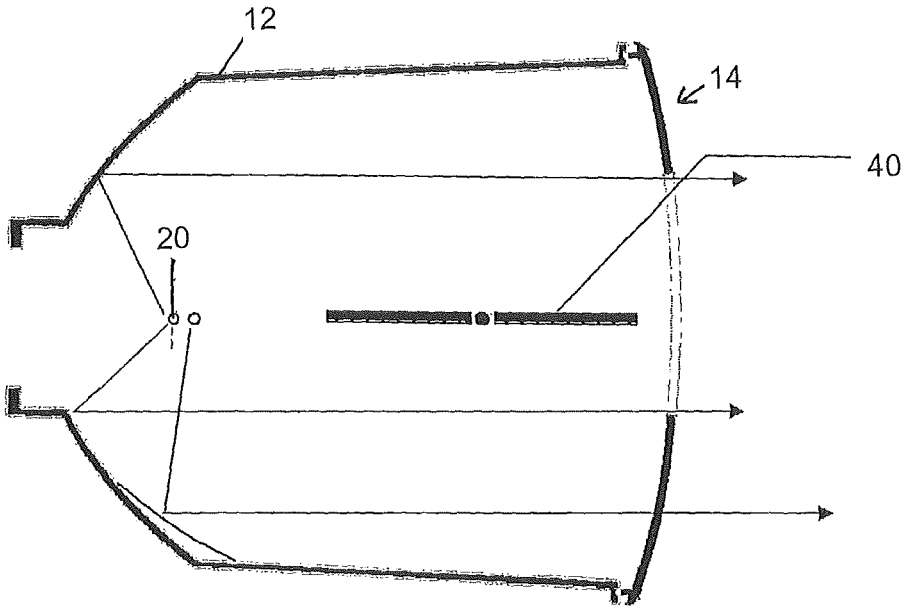
FIG. 2 is a side view of the multifunction taillight with the filter in a second position.
Figure 3:
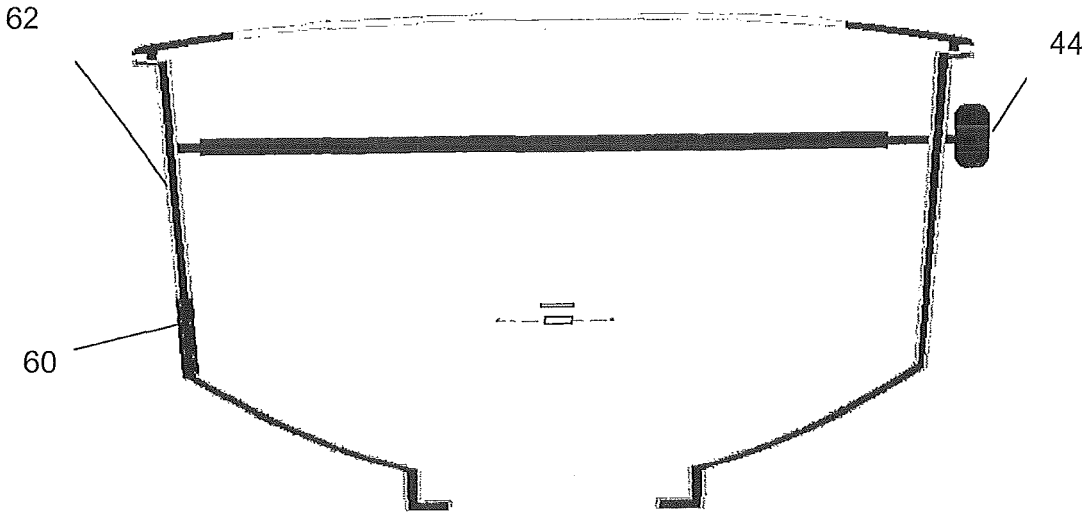
FIG. 3 is a top view of the multifunction taillight with the filter in a first position.
Figure 4:
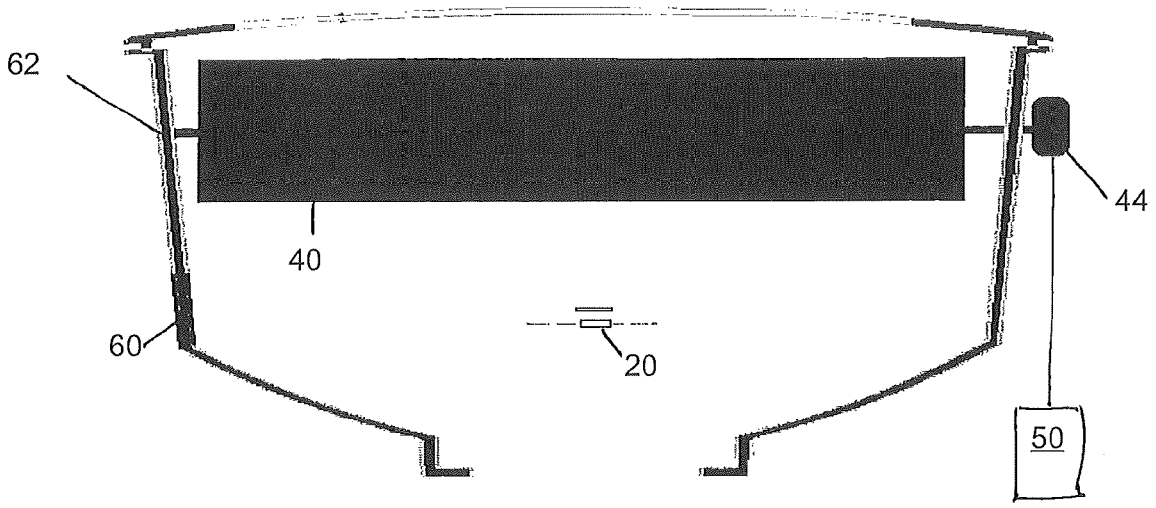
FIG. 4 is a top view of the multifunction taillight with the filter in a second position.

A filter 40 is mounted within the housing 12. The filter 40 is movable between a first position and a second position. FIGS. 1 and 3 depict the filter 40 in a first position. FIGS. 2 and 4 depict the filter 40 in a second position. In the depicted embodiment, said filter 40 moves between its first and second position by rotation around a pivotal mount 42. An actuator 44 may mediate travel of the filter 40 between its first and second position. The actuator 44 may be controlled by a controller 50 such as a processor or ASIC, which may receive signals from relevant inputs such as gear sensors in a transmission, brake sensors and the like.

The filter 40 has a light altering characteristic, such as a color or tint. In one embodiment, this first characteristic of filter 40 may match the first characteristic of the first portion 16 of the lens 14, for example both the filter 40 and first lens portion 16 may be tinted red.

In its first position, filter 40 is disposed such that light from one or both of said emitters 20, 22 passes through said filter 40 as well as through lens 14. In the depicted embodiment, the filter 40 is between the light emitters 20 and 22 and the lens 14, such that light from the emitters will pass through the filter 40 before passing through the lens 14.

In the depicted embodiment, the filter 40 is configured to substantially conform to the size and shape of the second portion 18 of the lens 14 with reference to the passage of light from the emitters through the filter 14. Thus, in the depicted embodiment, when the filter 40 is in its first position—vertical as depicted—light from the emitters will pass through the filter 40 and be tinted by it to a selected color, for example red, before continuing through the second portion 18 of the lens 14. Thus, when the filter 40 is in its first position, in the embodiment depicted where the filter and first lens portion 16 have the same color characteristic, the entire lamp, when viewed from outside the vehicle, will appear to have a single uniform color, for example red.

Filter 40 may optionally have third, separate light characteristics such as reflectivity or optical characteristics, for example focus or refraction, in user selectable manners.

When filter 40 is in its second position, as depicted in FIGS. 2 and 4, it is substantially parallel to the direction of travel of light beams from the emitters, and accordingly has little or no effect on those light beams. Hence, light from one or both of the emitters travels through the lens 14 and is imparted only with the characteristics of the two different portions 16 and 18 of the lens respectively. That is to say, when the lens is in its second position, the tail lamp, when viewed from outside, will have two colors, for example a red outer portion 16 and a clear central portion 18.

A color changing filter having at least two positions that variably affect the appearance of the tail light from outside advantageously allows multiple functions to be performed by the same lamp unit. Consequently, this leads to the further advantages in the design of the vehicle using the multifunction lamp of the invention. It obviates the need to provide for multiple separate lamps. The functions that may be performed by the multifunction lamp of the present invention include, without limitation, the unit functioning as a tail lamp, a reverse lamp, a turn indicator, a brake or stop lamp, a sidemarker light and a reflex lamp or reflector. By way of illustration and not limitation, the first portion 16 of the lens 14 and the filter 40 may be red, while the second portion 18 of the lens 14 may be clear. In this configuration, with the filter up in its first position, the entire lamp would appear red when viewed from the outside. In such red configuration the multifunction lamp, with its light emitters off would serve as a reflector. With one or both light emitters activated by braking, still with the filter up, the entire lamp would be illuminated red, indicating that the vehicle is stopping. When the secondary emitter 22 is intermittently illuminated, still with the filter up, the entire lamp would blink red, thus executing the familiar tail turn indicator function.

With the filter 40 down and withdrawn from the path of the light beams, light would proceed directly from one or both emitters 20/22 through the second portion 18 of the lens 14, which in this illustration is clear. Accordingly, the multifunction lamp is enabled to serve as a reverse lamp. While braking in reverse, the filter 40 would return to its vertical position, thereby interrupting the path of the light from the emitters, and again the lamp would appear entirely red when viewed from outside.

When the filter is down, particularly if the center portion 18 of the lens is clear, the first portion 16 of the lens 14 may lose some of its relative light intensity. Accordingly, a dedicated optic 32 may be included in the assembled multifunction lamp 10, or may be integrally formed in the reflective surfaces 30 of the housing 12, in order to add intensity to the first portion 16 of the lens 14.

Function control may be executed by a controller, as for example an ASIC. For example, the controller may be configured to receive a signal from the transmission that the vehicle is in reverse mode, and in response emit an output signal to a solenoid or other actuator 50 to move the filter 40 from its first position to its second position, thereby actuating the reverse function of the multifunction lamp. Similarly, when a controller receives a signal from the brake system that the brakes are being applied, it may be configured to respond by outputting a signal to the filter to return to its first or vertical position, thereby making the lamp appear entirely red when viewed from outside and achieving a brake light function.

Further depicted in FIGS. 3 and 4 are side lenses 60. These may be tinted, coated, created on a surface as by for example lenticular or scalloped surface treatment, or otherwise made to serve as reflectors and/or may be transparent. Side lenses 60 in the depicted embodiment are incorporated into the housing 12 in order that the first or second light emitter 20, 22, individually or in combination may illuminate the side lens 60. Accordingly, side reflector and side turn indicator functions may also be achieved by the overall assembly of the depicted embodiment. Side reflector functions may be achieved integrally with the side lens 60 or by a separate reflector 62.

As various modifications could be made to the exemplary embodiments, as described above with reference to the corresponding illustrations, without departing from the scope of the invention, it is intended that all matter contained in the foregoing description and shown in the accompanying drawings shall be interpreted as illustrative rather than limiting. Thus, the breadth and scope of the present invention should not be limited by any of the above-described exemplary embodiments, but should be defined only in accordance with the following claims appended hereto and their equivalents.

What is claimed is:

1. A multifunction vehicle light comprising:

a housing;

at least one light emitter mounted within said housing;

a lens disposed in cooperating relation to said housing;

a filter disposed within said housing and between said light emitter and said lens, said filter having a first position and a second position; said first position being in a light path and said second position being out of said light path said lens having a first portion and a second portion, said first portion having a first color and said second portion having a second color;

said filter also having said first color;

wherein light from said lamp appears to be entirely in said first color when said filter is in said first position, said light from said lamp comprising a first and second portions of light emitted by said light emitter and said first portion of said light from said light emitter passing through both said filter and through said first portion of said lens and said second portion of said light from said lamp passing through said second portion of said lens without passing through said filter;

wherein and light from said lamp appearing in both said first color and said second color corresponding to said first portion and said second portion of said lens, when said filter is in said second position, said first portion of said light from said light emitter passing through said first portion of said lens and said second portion of said light from said light emitter passing through said second portion of said lens without passing through said filter.

2. The multifunction vehicle light of claim 1 further comprising:

a second light emitter.

3. The multifunction vehicle light of claim 1 further comprising:

said light being, when said filter is in said first position, at least one of a running taillight, a brake light or a turn indicator.

4. The multifunction vehicle light of claim 1 further comprising:

said light being, when said filter is in said second position a reverse light.

5. The multifunction vehicle light of claim 1 further comprising:

said light being, a reverse light and at least one of a running taillight, a brake light or a turn indicator.

6. The multifunction vehicle light of claim 1 further comprising:

said lens also comprising a reflector.

7. The multifunction vehicle light of claim 1 further comprising:

a side lens.

8. The multifunction vehicle light of claim 7 further comprising:

said side lens being a turn indicator.

9. The multifunction vehicle light of claim 1 further comprising:

said filter being configured to be in said first position when at least one of running light, a brake or a turn indicator is on.

10. The multifunction vehicle light of claim 1 further comprising:

said filter being configured to be in said second position when the vehicle is in a reverse gear.

* * * * *